US005526744A

United States Patent [19]

Meschi

[11] Patent Number: 5,526,744

[45] Date of Patent: Jun. 18, 1996

[54] TRANSVERSAL PERFORATING APPARATUS AND RESPECTIVE PERFORATING METHOD FOR PRINTERS FED BY CONTINUOUS PAPER WITHOUT LONGITUDINAL DRAGGING HOLES

[75] Inventor: Luciano Meschi, Rosignano Marittimo, Italy

[73] Assignee: Industria Grafica Meschi S.r.l., Leghorn, Italy

[21] Appl. No.: 317,638

[22] Filed: Oct. 3, 1994

[30] Foreign Application Priority Data

Oct. 11, 1993 [IT] Italy ..... FI93A0190

[51] Int. Cl.[6] ..... B41F 13/56

[52] U.S. Cl. ..... 101/227; 400/621; 83/324

[58] Field of Search ..... 101/224, 226, 101/227; 400/621; 83/324, 342, 286, 287, 288

[56] References Cited

U.S. PATENT DOCUMENTS

| | | | |
|---|---|---|---|
| 4,366,753 | 1/1983 | Glanz et al. | 101/227 |
| 4,538,515 | 9/1985 | Tymkewicz et al. | 101/226 |
| 4,590,859 | 5/1986 | Pou et al. | 101/227 |
| 4,603,630 | 8/1986 | Llaneza | 101/227 |
| 4,706,566 | 11/1987 | Kishine et al. | 101/224 |
| 5,000,812 | 3/1991 | Murphy | 156/268 |
| 5,119,725 | 6/1992 | Okamura | 101/226 |

FOREIGN PATENT DOCUMENTS

| | | | |
|---|---|---|---|
| 0204866 | 12/1986 | European Pat. Off. . | |
| 0228758 | 7/1987 | European Pat. Off. . | |
| 3132113 | 3/1983 | Germany . | |
| 132559 | 8/1983 | Japan | 101/226 |
| 250955 | 12/1985 | Japan | 101/224 |
| 1079169 | 3/1984 | U.S.S.R. | 101/226 |
| 8704658 | 8/1987 | WIPO . | |
| 9205959 | 4/1992 | WIPO . | |

OTHER PUBLICATIONS

Patent Abstracts of Japan, vol. 9, No. 94 (M-374)(1817), 24 Apr. 1985 & JP-A-59 218 876 (Shinko Denki KK).

Patent Abstracts of Japan, vol. 14, No. 527 (M-1050), 20 Nov. 1990 & JP-A-02 223 462 (Oki Electric Ind. Co. Ltd.), 5 Sep. 1990.

Patent Abstracts of Japan, vol. 6, No. 204 (M-164), 15 Oct. 1982 & JP-A-57 110 480 (Fujitsu KK), 9 Jul. 1982.

*Primary Examiner*—Christopher A. Bennett
*Attorney, Agent, or Firm*—Browdy and Neimark

[57] ABSTRACT

Transversal perforating apparatus of paper for printers fed by a continuous strip of paper (1) without lateral dragging holes. The apparatus (12) includes a perforator roller (13) holding a blade (16) substantially transverse to and engaging a pressure roller (14) rotating in synchronism with the perforator roller (13). The speed of the perforator roller (13) is varied and the position of the blade (16) is measured with respect to the paper. Encoders communicate with a central processor. Transverse perforations are made coincident with the beginning and the end of each page printed by printing heads (2,3). Intervals between two successive perforations can be varied during the course of printing.

7 Claims, 3 Drawing Sheets

TRANSVERSAL PERFORATING APPARATUS AND RESPECTIVE PERFORATING METHOD FOR PRINTERS FED BY CONTINUOUS PAPER WITHOUT LONGITUDINAL DRAGGING HOLES

FIELD OF THE INVENTION

The present invention generally relates to the field of printers and more precisely it relates to an apparatus for the transversal perforation of paper for printers fed by a continuous strip of paper without longitudinal dragging holes. Furthermore, the invention relates to the respective method for synchronization of the perforation of the paper with the beginning of the printed page.

BACKGROUND OF THE INVENTION

Data printers generally use paper already provided with transversal perforations for the separation of adjacent sheets and furthermore use paper having lateral longitudinal holes which allow it to be dragged by means of paper-dragging rollers provided with small teeth which engage in said holes. The paper, therefore, requires treatment upstream from printing consisting in the unrolling of virgin paper and the forming of lateral holes and transversal perforations, the perforations being produced at a fixed interval such as 12 inches. The paper is then furnished in bobbins or in packages of folded "accordion" sheets.

The presence of the lateral dragging holes normally facilitates the control of the paper during the printing step which can be carried out by means of paper-dragging rollers. The transversal perforations are, on the other hand, normally accompanied by a preceding notch which allows a sensor to inform the printer of the exact position of said perforations in order to allow the printing heads to initiate printing in correspondence to the beginning of each sheet of paper delimited by two consecutive perforations.

The need for printers, especially when of large dimensions, which operate with a continuous strip of paper that has not been pre-processed, and, instead, comes directly from the paper mill in the form of a bobbin, is strongly felt. Such paper obviously lacks lateral dragging holes and transversal perforations. Thus savings are obtained both by the fact that, by not having lateral borders which comprise the dragging holes, the strip is narrower, and thus less paper can be used, and by the fact that, by not having to be pre-processed, the paper can be obtained directly from the mill at a lower price. These two savings are advantageous to large printer users, such as banks, utilities companies, firms, etc. with large numbers of clients to whom it is necessary to communicate information such as invoices, financial statements, bulletins, etc.. The quantity of paper in circulation is enormous, and printers able to satisfy volumes of this nature operate at a considerable velocity, for example 50–100 cm/sec and faster.

A type of data printer which operates using paper not provided with lateral dragging holes and which produces, at the output, by means of shears, single sheets obtained from the strip of paper printed back and front is well-known. The use of the shears makes transversal perforations unnecessary, whereas the absence of the dragging holes is compensated for by processing the paper taut. The control of the beginning position of each printed sheet occurs in correspondence to the printing heads which send corresponding signals to a central processing unit which also commands the shears at the output. Errors in the calculation of the beginning position of each sheet can occur, however, due to sliding of the paper with respect to the dragging rollers or stretching of the paper itself as a result of the tension. Said errors, however, can be reduced to a negligible amount, bringing the printer to function in constant operative conditions.

In many cases, for the control of the quality and accuracy of the printed data, it is necessary that the paper exiting the printer still be in a continuous strip, and produced in folded "accordion", packages. In such cases, it is necessary for the paper, at the beginning of printing, to already have the transversal perforations suitable to allow the tearing apart from one another of adjacent sheets of paper in a later step.

This characteristic, however, implies certain difficulties which currently cannot be overcome in the case that one wishes to carry out printing starting with a virgin strip of paper. Consequently, in these cases, one must use pre-processed paper already comprising lateral dragging holes and transversal perforations.

The object of the present invention is to provide an apparatus for the transversal perforation of paper to insert in printers fed by a continuous strip of paper without lateral dragging holes, in order to allow for the above-mentioned savings.

A further object of the present invention is to provide a method for the transversal perforation, within the printer, of a strip of paper or similar material without lateral dragging holes, in synchronism with the beginning of each printed sheet.

These objects are accomplished by the transversal perforating apparatus according to a method for transversal perforation of a strip of paper within a printer.

BRIEF DESCRIPTION OF THE DRAWINGS

Further characteristics and advantages of the transversal perforating apparatus according to the invention and the respective method of perforation will become more apparent in the following description of one of its possible embodiments, given as an example and not limitative, with reference to the attached drawings in which.

DESCRIPTION OF A PREFERRED EMBODIMENT

Figure 1:
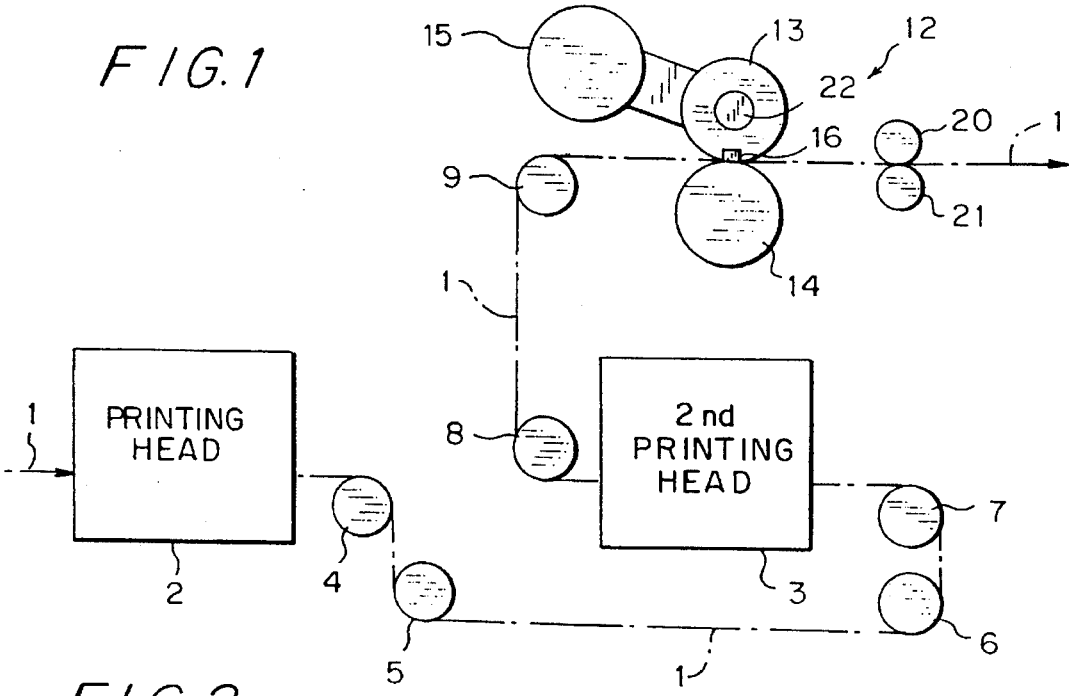
FIG. 1 is a schematic view of a transversal perforating apparatus according to the invention placed downstream from two printing units.
Figure 2:
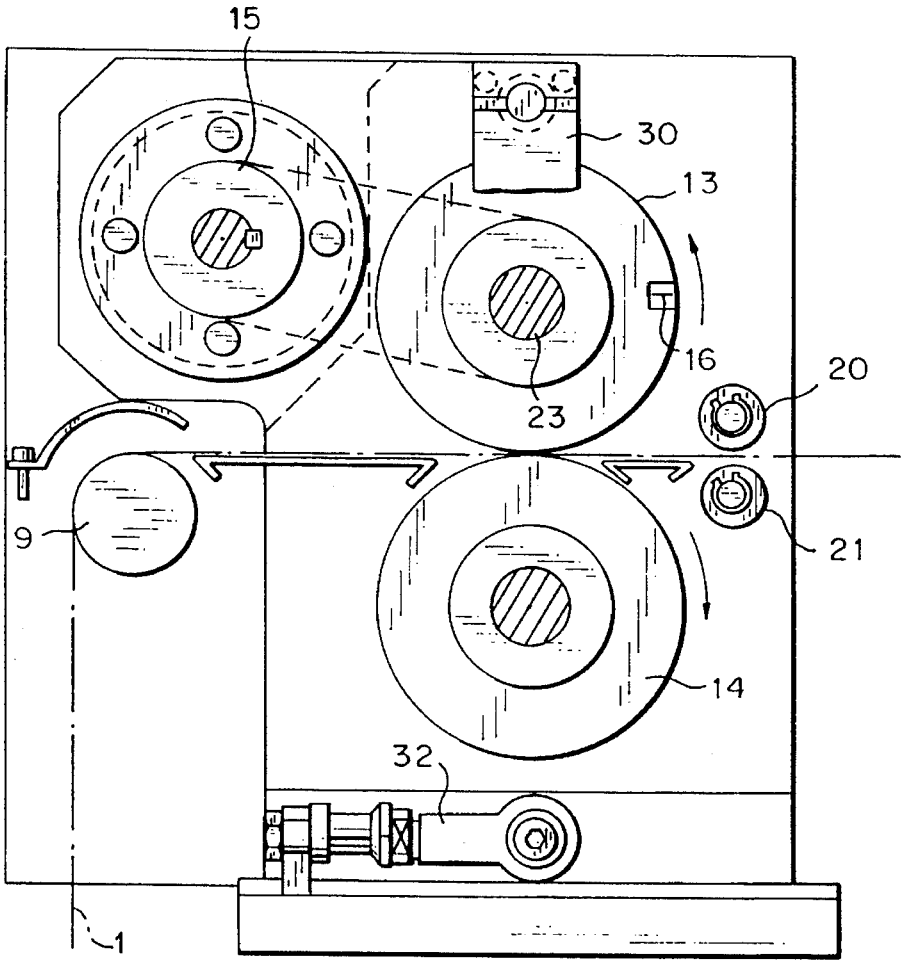
FIGS. 2, 3 and 4 show the printing apparatus of FIG. 1 respectively in a side sectional view, a bottom view and a transversal sectional view.

With reference to FIG. 1, a printer printing on a continuously fed strip 1 of paper comprises a printing head 2, acting on one face (front) of strip 1, and a second printing head 3 for the printing of the other face (back) of the paper. The paper is guided by deflector rollers 4, 5, 6, 7, 8 and 9 in its advancement from printing head 2 through head 3 to reach a perforating apparatus 12 comprising a perforator roller 13 and a pressure roller 14 rotating in the directions opposite one another and driven by a motor 15. Perforator roller 13 has a blade 16 in a position substantially transversal to paper 1 so as to produce a perforation on it with each rotation of roller 13 itself because the paper is interposed between blade 16 and roller 14. Friction dragging rollers 20 and 21 operated in a known and not shown manner by engine 15, provide for the dragging of the paper and are located downstream from perforating apparatus 12. On the axis of roller 13 an encoder 22 is provided which measures the rotations completed by blade 16, thus allowing for the identification of the exact moment in which each transversal perforation must be carried out.

Figure 3:
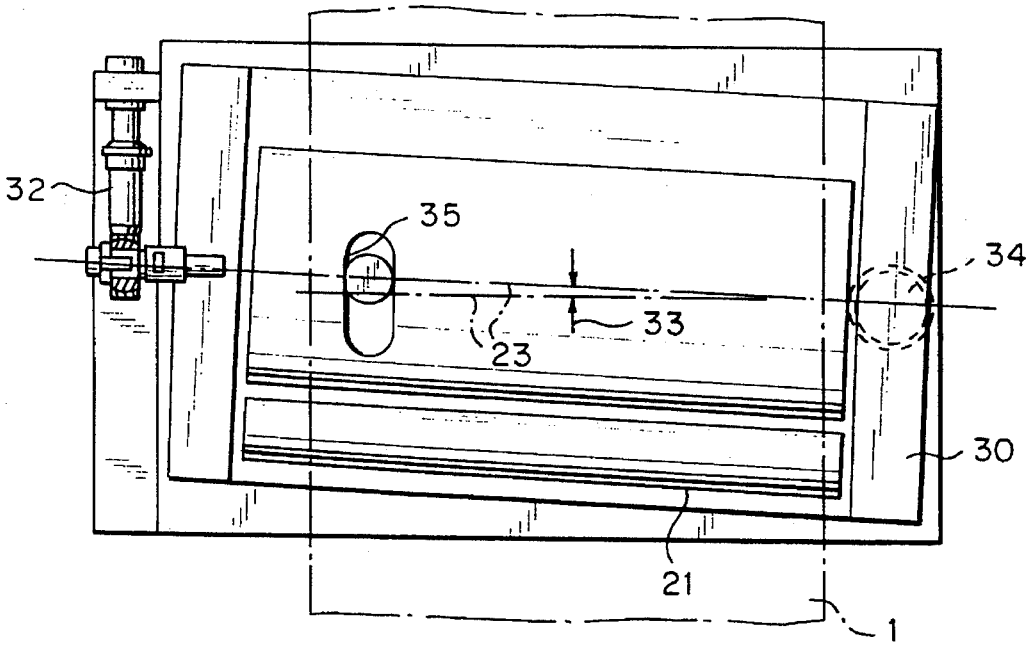
Figure 4:
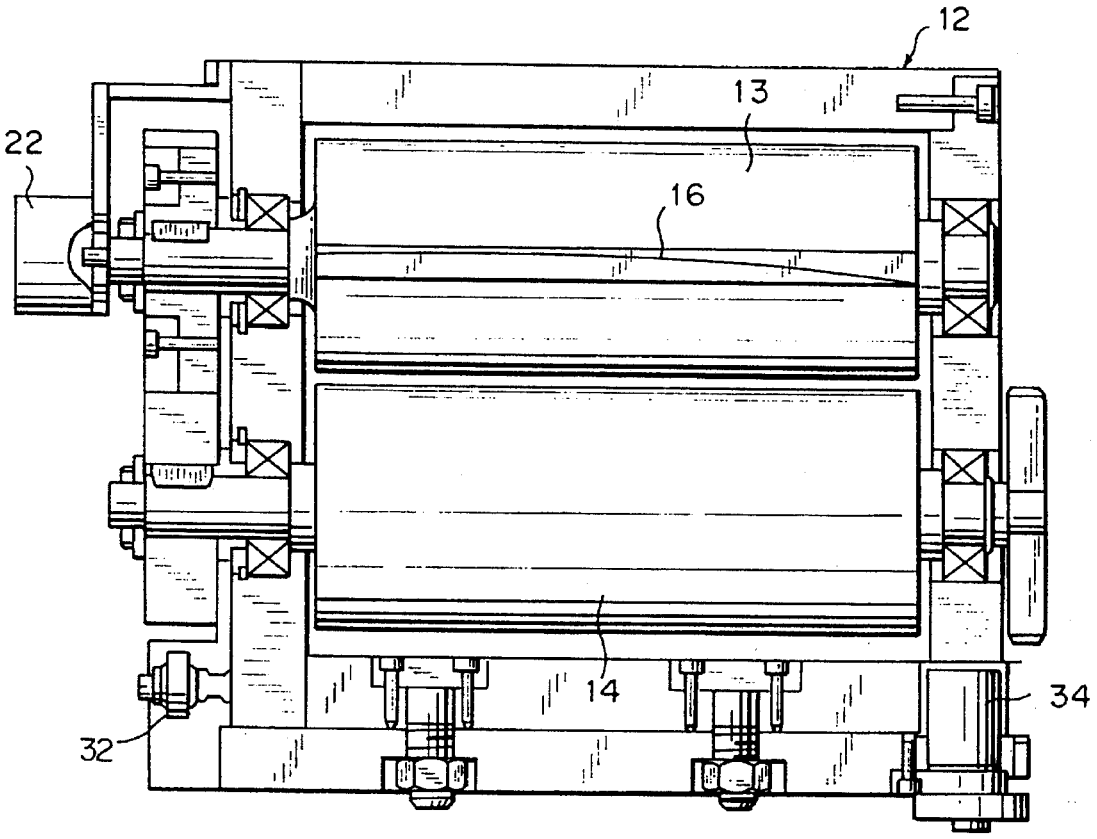

Preferably, as shown in FIG. 4, blade 16 is helicoida, instead of rectilinear, on the surface of roller 13. The axis 23 of roller 13 is not orthogonal to paper 1, but inclined and mounted on a support 30 (FIG 3) which allows for the regulation of its inclination. This regulation is possible through screw means 32 which can vary the inclination 33 of axis 23 with respect to a fixed pivot 34 and a slot guide 35. As is known, a helicoidal blade produces a rectilinear cut on a strip of paper advancing at a predetermined speed, provided that the plane containing the axis of inclination of the blade is inclined by a predetermined degree so that the contact points of the blade, as it descends on the paper, lie on a line orthogonal to the advancement of the paper. In this case helicoidal blade 16 is applied to a roller 13 whose axis 23 is advantageously regulated, in order to adjust the position of the blade so that the perforation is made on the paper orthogonally to the longitudinal border thereof. The inclination of the roller is normally set when the blade is changed and is a function of the pitch of the blade helix. It is important that the tip speed of roller 13 coincides with that of paper 1 during perforation.

Figure 6:
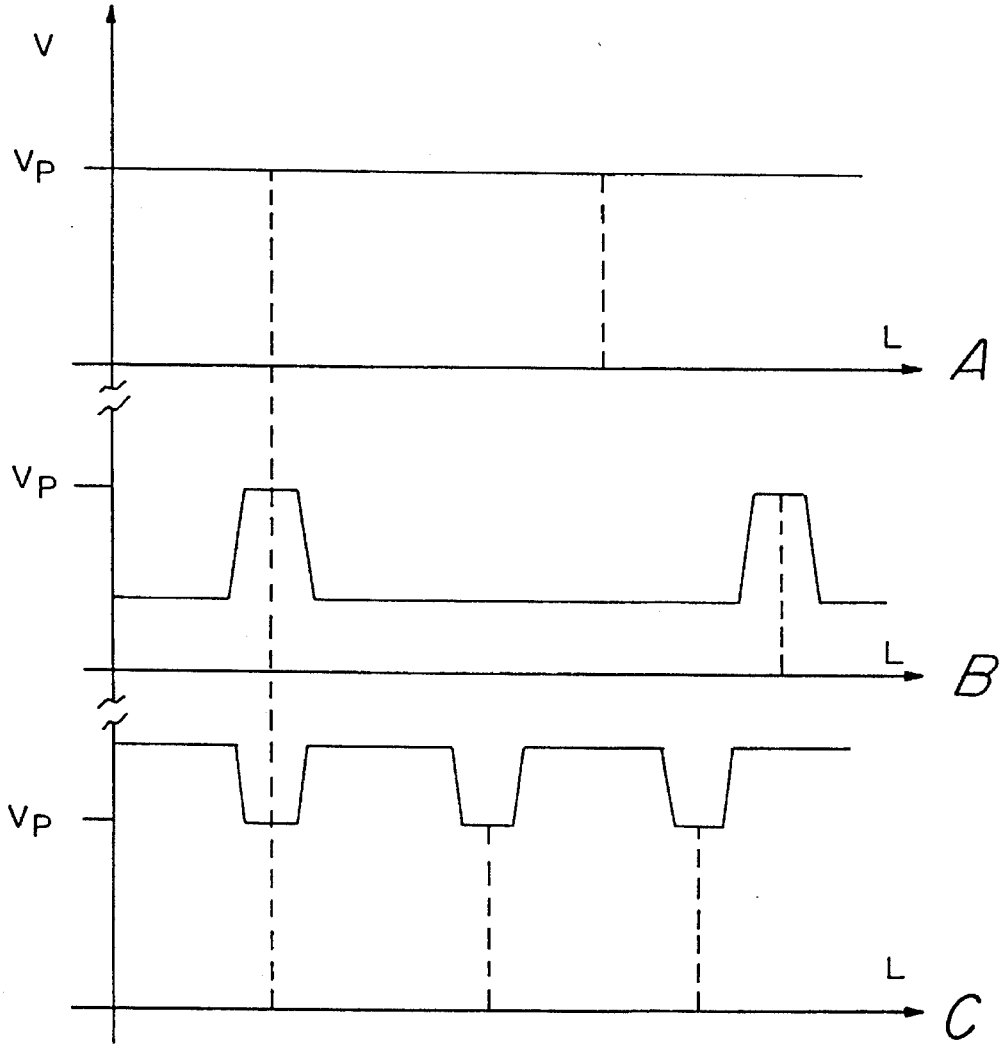
FIG. 6 shows a diagram of variations in the rotational speed of the perforator roller of the apparatus according to the invention.

It is thus possible, according to the present invention, to produce transversal perforations at any predetermined distance from one another. In fact, as shown in the diagram of FIG. 6, by varying the speed of roller 13 in each period in which the perforation does not occur the frequency of the contacts between blade 16 and paper 1 can be varied. The vertical axis, labeled "V", represents the peripheral velocity or tip speed of the roller 13 (i.e., the speed of the blade 16 that is mounted on the periphery of the roller 13). The velocity V axis interrupted, so that FIG.6 actually comprises three distinct graphs. In each graph, "$V_p$" represents the tip speed which matches the speed of the web (paper strip) passing by the roller 13. In case A, for example, the rotation of roller 13 occurs at a constant speed $V_p$ equal to the speed of paper 1, and, therefore, the distance between two consecutive perforations is equal to the circumference covered in one rotation of blade 16. In case B, apart from the exact instant of the cut, roller 13 slows to the peripheral speed $V_p$ matching the linear speed of the web, thereby allowing more paper to pass, thus obtaining a longer time interval between two consecutive perforations. In case C, inversely, the time interval between two consecutive perforations is shorter than in case A, using a rotation speed of roller 13 greater than the speed $V_p$ of the web with respect to the advancement speed of the paper except for the period surrounding the instant of the cut.

Figure 5:
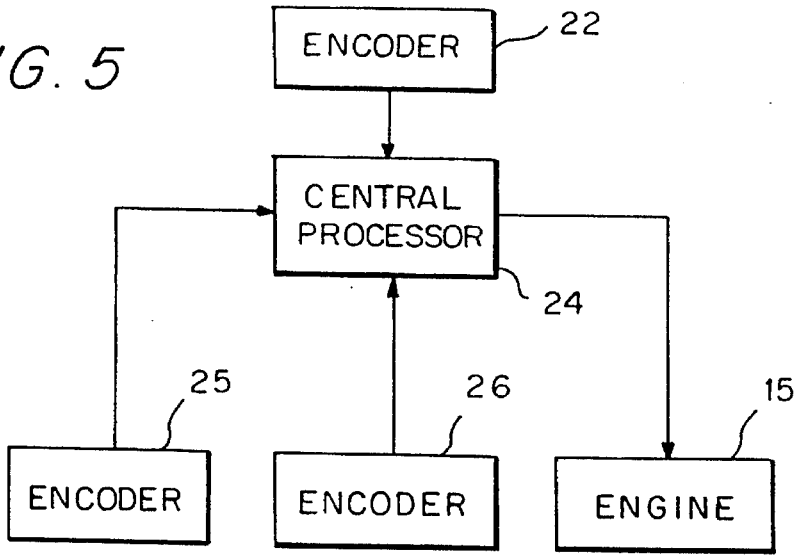
FIG. 5 shows a diagram of connections between the perforating apparatus according to the invention and a central processor.

The instant of the cut is communicated by encoder 22 to a central processor 24 (FIG. 5) which at the same time receives the data of the printing heads 2 and 3 provided by corresponding encoders 25 and 26, which are not shown in FIG. 1 and which are integral with the axes of the printing rollers (not shown) of the respective printing heads 2 and 3. Printing is initiated by head 2, in synchronism with head 3, so that the printing on the front and back of the paper coincide. The two perforations that delimit each sheet are then performed automatically by the perforating apparatus 12 and coincide with the beginning and end of the page itself.

More precisely, this result is achieved by virtue of the presence of encoder 22 on the rotational axis of roller 13 of perforating apparatus 12. In fact, encoder 22 controls the position of blade 16 of roller 13 and informs processor 24, which can be programmed in a manner known to a person skilled in the art, in order to correspondingly accelerate or decelerate the speed of engine 15 depending on the selected distance between two successive transversal perforations. The information relating the position of the beginning or end of each page is calculated by processor 24 itself, according to the information coming from encoder 25 or 26 of heads 2 and 3 respectively. In other words, when the whole printing machine is set before the first start, the distance between a position of zero of encoder 3 (or 2) and the position of the blade 16 is measured and stored in processor 24. In this way, the latter can calculate the exact correspondence between the beginning or end of each printing page signalled by encoder 26 (or 25) and the cutting moment, related to encoder 22. In more detail, when encoder 26 has measured a linear extension of the paper equal to the distance existing between the point of zero of encoder 26 itself and the perforating position under blade 16, the perforation must occur in that moment. Roller 13, therefore, should be previously accelerated or decelerated as shown in FIG.6 so that blade 16 is ready to perforate just in that moment.

It is, therefore, possible to obtain the continuous printing of paper not yet provided with transversal perforations, and produce transversal perforations in exact coincidence with the beginning and end of each page with high precision.

A printer which comprises the perforating apparatus according to the present invention is, therefore, very flexible in that it allows the variation in rapid succession, of sheet sizes of paper without having to stop the printer itself. According to known techniques, on the other hand, it would have been necessary to use perforated paper at a fixed interval, each variation of the interval between two successive perforations requiring a change of the paper causing a considerable loss of time. Notwithstanding the fact that the paper used is without lateral dragging holes, the presence of the encoder 22 which anticipates the signal for the beginning of printing by the heads 2 and 3 by means of a central processor, makes it possible to produce the transversal perforations at the beginning and end of each printed page with precision.

I claim:

1. Transversal perforating apparatus for the paper of a printer, said printer being fed by a continuous strip of paper without lateral dragging holes and being provided with a printing head crossed by said strip, comprising a central processor and control means of the linear position of the strip, said control means communicating with the central processor, a perforator roller having an axis substantially orthogonal to said strip and holding a blade substantially parallel to said roller, a pressure roller pressing against said blade at every rotation of said perforator roller, speed variation means for varying the speed of said perforator roller, measuring means for measuring the position of said blade with respect to said paper communicating with said central processor, said variation means accelerating or decelerating said perforator roller, during each period comprised between two successive perforations, operated by said processor calculating the position of said strip as communicated by said control means.

2. Apparatus according to claim 1, wherein said measuring means comprise an encoder integral with said axis of said perforator roller.

3. Apparatus according to claim 1, wherein said blade has a helicoidal form, a support being provided on which said perforator roller is mounted and which comprises inclining means of said support with respect to the direction orthogonal to said strip.

4. Apparatus according to claim 1, wherein said blade has a helicoidal form and said perforator roller is mounted on a support which can be inclined with respect to the direction orthogonal to said strip.

5. Method for transversal perforation within a printer of a strip of paper or similar material without lateral dragging holes in synchronism with the beginning and end of each printed page, characterized in that it comprises the steps of:

dragging said paper through a perforating apparatus producing transversal perforations on the same;

measuring the linear extension of said paper crossing the printing heads comprised in said printer;

calculating the position corresponding to the beginning of each printed page, varying the speed of the perforating apparatus, as function of the distance between the beginning and the end of each printed page, during each interval between two successive perforations.

6. An apparatus for printing on and perforating a continuous paper strip web, the apparatus comprising:

means for web feeding and tensioning;

a central processor;

a least one printer for printing blocks of print on the web;

a print encoding detector coupled to the central processor for signalling to the central processor when each of the blocks is printed;

a transverse perforator comprising a pressure roller, a perforator roller, and a motor drive, the perforator roller including a perforating blade, the motor drive coupled to the central processor;

means for the central processor to accept print block signals from the encoding detector, calculate a time at which the perforating blade must contact the web for perforating the web between adjacent ones of the blocks, and accelerate and decelerate the perforator roller such that the perforating blade perforates the web between the adjacent ones of the blocks and perforation occurs while the blade is traveling at a tip speed equaling a web speed.

7. The apparatus according to claim 6, wherein the perforating blade is helicoidal and the perforator roller is askew a longitudinal extension of the web.

* * * * *